United States Patent [19]

Smith et al.

[11] 4,231,676

[45] Nov. 4, 1980

[54] COLLAPSIBLE TRAFFIC BARRICADE

[75] Inventors: Dennis W. Smith; Paul J. Mazzacano, both of Joliet, Ill.

[73] Assignee: F F Fabricators, Inc., Joliet, Ill.

[21] Appl. No.: 40,494

[22] Filed: May 21, 1979

[51] Int. Cl.[3] ..... E01F 13/00

[52] U.S. Cl. ..... 404/6; 256/64

[58] Field of Search ..... 404/6, 9; 256/64, 59, 256/65

[56] References Cited

U.S. PATENT DOCUMENTS

| | | | |
|---|---|---|---|
| 3,089,682 | 5/1963 | Parker | 256/64 |
| 3,456,100 | 7/1969 | Green | 256/64 X |
| 3,583,676 | 6/1971 | Yamakawa | 256/64 |
| 3,627,273 | 12/1971 | Birner | 256/64 |
| 3,802,667 | 4/1974 | Kanan | 404/6 X |
| 3,917,232 | 11/1975 | Lindner | 404/6 X |

*Primary Examiner*—Nile C. Byers, Jr.

*Attorney, Agent, or Firm*—Robert E. Wagner; Gerald T. Shekleton

[57] ABSTRACT

A Type I Traffic Barricade is described having a reflective panel mounted between a pair of leg supports. Each leg support has two legs pivotally secured together at an upper end and in a spaced relationship by a pair of brackets on opposing sides of the leg support. The brackets are placed into slots formed on an underside of the reflective panel and, with the legs spread for the widest possible stance at their lower end, the upper end is biased against the reflective panel for complete and stable vertical and lateral support, while allowing easy set-up and knock down with minimum space requirements for storage.

6 Claims, 5 Drawing Figures

COLLAPSIBLE TRAFFIC BARRICADE

BACKGROUND OF THE INVENTION

This application relates to a traffic control apparatus and, more particularly, to a collapsible road barricade for restricting or channeling the flow of vehicular traffic.

In general, road barricades are utilized for temporarily directing and protecting traffic, both vehicular and pedestrian. These temporary traffic control apparatus are commonly used at road construction and repair sites to close off unused traffic lanes, to obstruct ends of lanes, to delineate parade routes, to guard excavation and building sites, to control crowds in all types of major events, to designate rough or damaged roadway and sidewalks and to generally warn against hazards of all types. One of the most common, a Type I barricade, employs a sawhorse type construction, having a reflective panel mounted between a pair of leg supports, each leg support comprising two angularly disposed legs. The form generally approved and preferred by government regulatory agencies are those road barricades having fixed vertical reflective panels and non-rigid structures, i.e., a collapsible barricade. In addition, it is desirable that a road barricade be easily placed in an operative position from an inoperative state, as well as requiring a minimum amount of space and storage.

Therefore, an object of the subject invention is an improved road barricade capable of stability when placed on the road while being easily assembled and disassembled.

A further object of the subject invention is an improved road barricade which retains the reflective panel in a vertical position at all times when in an operative position.

A still further object of the subject invention is an improved road barricade which, when overturned by high winds, collision or the like, will immediately collapse and lay flat on the ground surface without protruding legs or the like.

Another object of the subject invention is an improved road barricade which, when not in use may be stored with the minimum of space requirements.

These and other objects are attained in accordance with the present invention wherein there is provided a road barricade having a reflective panel supported in a vertical position on a pair of spaced leg supports. Each leg support includes two individual legs secured together at a top portion in a pivotal manner by parallel cross braces separated by the leg. One bolt running through each leg attaches the legs to the brackets in a spaced relationship to each other for each pivotal movement of each leg relative to the other. Two slots are cut in each end portion of the reflective panel opening in a downward direction and spaced slightly less than the width of a leg. Assembly of the improved traffic barricade of the subject invention involves inserting the brackets fully into the slots of the reflective panel and spreading the lower ends of the leg apart as far as possible, allowing the upper ends of the legs to contact and be biased against the reflective panel.

DESCRIPTION OF THE DRAWINGS

Further objects of the invention, together with additional features contributing thereto and advantages accruing therefrom will be apparent from the following description of one embodiment of the invention when read in conjunction with the accompanying drawings wherein:

Referring now to FIG. 1, there is shown one embodiment of the traffic barricade 10 of the subject invention, having a reflective panel 15, having alternating dark and light contrasting reflective stripes 21 and 22 in the customary manner. The reflective panel 15 rests on and is supported by a pair of leg supports 20 which are engaged with the reflective panel 15 at opposite ends to form the overall configuration of a sawhorse. In the preferred embodiment the barricade 10 of the subject invention may be formed of fiberglas reinforced plastic, having hollow legs and a hollow reflective panel, supported at strategic locations by internal struts 16 (FIG. 2). Thus, no deterioration or weather related structural damage can occur. However, it should be recognized that the subject invention is not limited to any particular material and, in fact, may utilize a wooden reflective panel, or wooden legs, or both.

Figure 4:
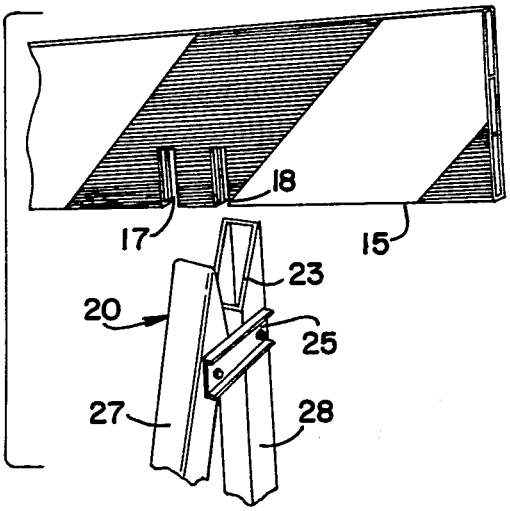
FIG. 4 is an exploded perspective view of a pair of legs and the slots of the reflective panel.

As best seen in FIG. 4, each leg support 20 comprises a pair of individual legs 27 and 28, each having a mitered upper end 23, preferably cut at a 30° angle to the longitudinal axis of the leg. The two legs 27 and 28 are secured together at an upper portion by brackets 25. As shown in the drawings, brackets 25 may comprise a channel or U-shaped length of fiberglas reinforced plastic with spaced parallel legs 29. Such a shape provides maximum strength with minimum weight. This feature, in combination with the hollow legs and hollow reflective panel contribute to a relatively lightweight barricade with maximum strength. However, the bracket may be simply a flat block of wood or metal, if desired. One bracket 25 is secured on either end of each leg with a rivet or nut and bolt arrangement 26 passing through the leg somewhat loosely to allow pivotal movement of the legs about the bolt. Nut and bolt assembly 126 may be coated metal to further assure the longevity of the traffic barricade of the subject invention regardless of the severity of the weather or the manner of its use. Bracket 25 attaches to an upper end of each leg of a pair with the tapered portion 23 of each leg 27 and 28 facing one another and each leg being spaced from the other.

Slots 17 and 18 are formed in the reflective panel 15, opening downwardly and preferably spaced from one another approximately slightly less than the width of a leg. The slots 17 and 18 are preferably of slightly greater width than the maximum width of a bracket. Should the bracket by U-shaped as shown in the drawings, then slots 17 and 18 have a width only slightly greater than the length of a leg 29.

Figure 1:
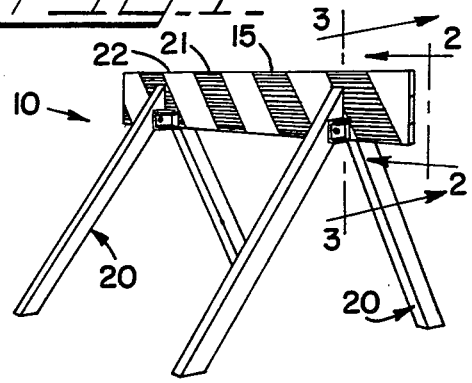
FIG. 1 is a perspective view of one embodiment of the improved traffic barricade of the subject invention.
Figure 2:
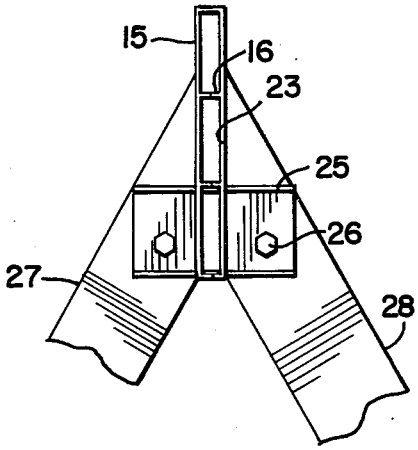
FIG. 2 is a partial side plan view of the improved traffic barricade of FIG. 1, taken along the lines 2—2 of FIG. 1.
Figure 3:
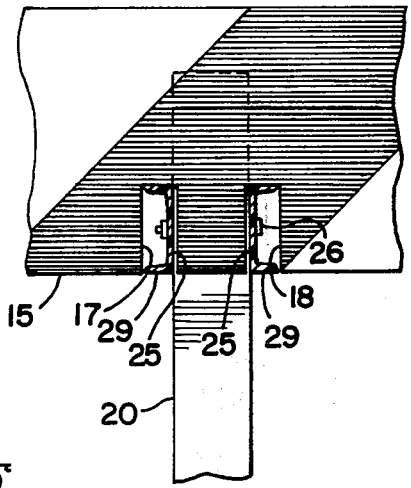
FIG. 3 is a partial front plan view of the improved traffic barricade of FIG. 1, taken along the lines 3—3 of FIG. 1, showing the brackets in the slots on one side for the support of the reflective panel.

Assembly of the improved traffic barricade of the subject invention is accomplished by the insertion of the reflective panel 15 onto the support assembly 20 by the insertion of brackets 25 into the slots 17 and 18. The result is shown in FIG. 3 which shows the relatively little play involved by the insertion of brackets 25 in slots 17 and 18, as a result of the forming of the slots substantially to the size of the bracket legs 29. Once the brackets 25 are in slots 17 and 18, and support legs 27 and 28 are spread, the beveled portion 23 of each support leg is brought into biased contact with the reflective panel 15 (FIG. 2). With the support legs spread in this manner, stable vertical support, as well as stable lateral support in the plane of the legs of the barricade is assured; with the brackets 25 positioned in slots 17 and 18 without substantial play, lateral stability in the plane of the reflective panel is also assured.

In addition to the great stability experienced in the barricade of the subject invention, the barricade 10 is easily collapsible. Such a feature promotes safety when a barricade is knocked over, as a great wind or collision with a car. When such an occurrence happens, the legs will not stick up in the air, as they will automatically fold to a generally flat position. Thus, they will not project angularly from the ground in the manner of spears.

Figure 5:
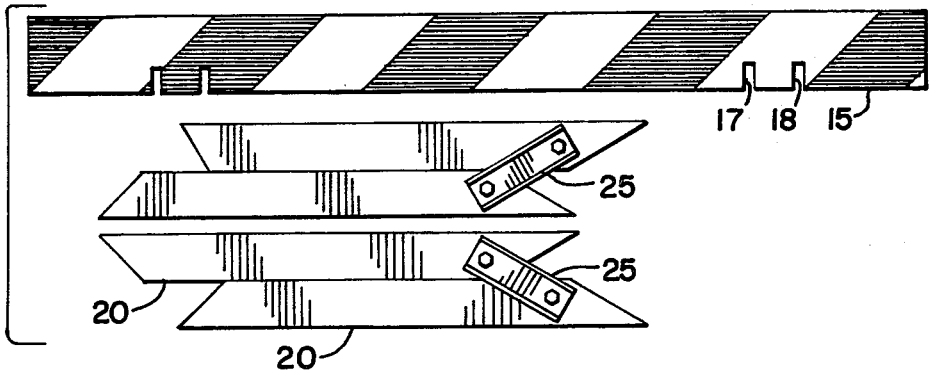
FIG. 5 is a top plan view of one embodiment of the improved traffic barricade of the subject invention in a disassembled state.

The easy assembly of the barricade of the subject invention also extends to its disassembly, which includes the lifting of the reflective panel 15 from the leg support and the folding of the leg supports to that position shown in FIG. 5. Storage in such a position becomes greatly simplified and requires substantially less storage space as each component may be stored flat on one another without wasting the space normally experienced in the storage of traffic barricades. Not only can many more barricades be stored per unit space, but also many more barricades may be transported with a great deal less trucks when truckloads of barricades are required for placement. Such an advantage means that less equipment and manpower is needed in the placement of traffic barricades, freeing these expensive commodities for other uses.

While the invention has been described with reference to a preferred embodiment, it wil be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carryng out this invention, but that the invention will include all embodiments falling within the scope of the appended claims.

We claim:

1. A collapsible traffic barricade assembly for the control of traffic, the identification of traffic lanes and the like, having a center panel with opposing end portions and two supporting leg assemblies, at least one slot formed of a certain width in each end portion of said center panel, each of said slots extending inward from a lower edge of said center panel, each of said supporting leg assemblies comprising two leg members, said leg members being joined by a bracket at an upper end, said bracket having a certain maximum thickness, said maximum thickness being equal to or slightly less than said certain slot width, said bracket being attached to each leg member for pivotal movement of each of said leg members, said bracket spacing said leg members from one another to allow insertion of said bracket into said slot whereby said center panel is supported by said leg assemblies in a substantially horizontal manner, the lower ends of said leg members being spread to bias said upper end against said center panel, whereby the substantial equivalency in size of said slot and said bracket thickness in combination with the bias of said upper end against the center panel contributes to great lateral stability while said barricade assembly is easily collapsible and said leg members are capable of pivoting to a substantially flat position on collision or disassembly.

2. The traffic barricade assembly of claim 1 wherein said bracket comprises a U-shaped member, the legs of the bracket being of substantially equivalent width as the width of said slot.

3. The traffic barricade assembly of claim 1 wherein at least two brackets join said leg members, each of said brackets being insertable into an individual slot in said center panel.

4. The traffic barricade assembly of claim 1 wherein said leg members have upper ends which are formed at an angle for a flush-joining of said upper ends with said center panel.

5. The traffic barricade assembly of claim 1 wherein each of said center panels and said leg assemblies is formed of a weather-resistant material for longevity and strength.

6. The traffic barricade assembly of claim 5 wherein said weather-resistant material comprises a fiberglass impregnated plastic.

* * * * *

UNITED STATES PATENT OFFICE
CERTIFICATE OF CORRECTION

PATENT NO. : 4,231,676
DATED : November 4, 1980
INVENTOR(S) : Dennis W. Smith; Paul J. Mazzacano It is certified that error appears in the above-identified patent and that said Letters Patent are hereby corrected as shown below:

In [73] Assignee: F F Fabricators, Inc., Joliet, Ill. should appear as -- [73] Assignee: F R Fabricators, Inc., Joliet, Ill. --

In column 1, line 53, the word appearing as "each" should be -- easy --

In column 2, line 51, the number appearing as "126" should be -- 26 --

Signed and Sealed this

*Thirteenth* Day of *October 198*

[SEAL]

*Attest:*

GERALD J. MOSSINGHOFF

*Attesting Officer*

*Commissioner of Patents and Trademarks*